United States Patent [19]

Hanna

[11] Patent Number: 4,908,906

[45] Date of Patent: Mar. 20, 1990

[54] AMBULATORY ASSISTANCE DEVICE SUCH AS A GRAB BAR OR THE LIKE

[75] Inventor: Emmanuel Hanna, Sun Valley, Calif.

[73] Assignee: Bobrick Washroom Equipment, Inc., North Hollywood, Calif.

[21] Appl. No.: 67,105

[22] Filed: Jun. 25, 1987

[51] Int. Cl.[4] ..... A47K 17/02

[52] U.S. Cl. ..... 16/126; 4/576

[58] Field of Search ..... 16/126, 112, 113, 110 R, 16/DIG. 24, 306, 307, 308, 289; 4/576; 5/445

[56] References Cited

U.S. PATENT DOCUMENTS

| | | | |
|---|---|---|---|
| 823,372 | 6/1906 | Stevens et al. | 16/1 C |
| 2,059,171 | 10/1936 | Harris | 4/576 |
| 3,228,038 | 1/1966 | Augustine | 4/576 |
| 3,286,283 | 11/1966 | Bertoldo | 5/445 |
| 3,562,849 | 2/1971 | Brayshaw | 16/126 |

FOREIGN PATENT DOCUMENTS

| | | | |
|---|---|---|---|
| 1964410 | 7/1971 | Fed. Rep. of Germany | 4/576 |

*Primary Examiner*—Nicholas P. Godici
*Assistant Examiner*—Carmine Cuda
*Attorney, Agent, or Firm*—Lyon & Lyon

[57] ABSTRACT

The present invention provides an ambulatory assistance device such as a grab bar or the like which pivots between a non-in-use and an in-use position. The pivoting of the device is assisted by a torsion member acting between the base member and the body. The torsion device is selected so as to retain the body in its non-in-use position when placed in that position. The weight of the pivoting body of the present invention overcomes the force generated by the torsion member when the body is placed in the in-use position so as to retain that orientation. Moreover, the torsion member acts to assist the user of the device in counteracting the weight of the pivoting body member when the body member is moved between the non-in-used position and the in-use position.

2 Claims, 2 Drawing Sheets

AMBULATORY ASSISTANCE DEVICE SUCH AS A GRAB BAR OR THE LIKE

BACKGROUND

The present invention relates to an ambulatory assistance device, and more particularly to an ambulatory assistance device such as a grab bar or the like which may be pivoted between an in-use position and a non-in-use stored position.

As is known to persons who design and equip facilities which are usable by the general public, it is highly desirable and oftentimes necessary to provide ambulatory assistance devices. Although these devices are probably most commonly used by persons having ambulatory handicaps, these devices may also be used by anyone who requires or merely feels the need for ambulatory assistance.

One device which is known to persons in the art for providing this type of assistance is commonly referred to as a grab bar device. While some of the prior devices are arranged such that the device may swing or pivot aside when it is not in-use, none of these devices provide a grab bar device or the like which may swing or pivot between a non-in-use position and an in-use position wherein the device will maintain its selected position or orientation without the use of an auxiliary locking mechanism or which requires the user to move the device through some other locking motion.

SUMMARY OF THE PRESENT INVENTION

The present invention provides an ambulatory assistance device such as a grab bar device or the like which can swing or pivot between a non-in-use position and an in-use position. The present invention acts to maintain its selected position or orientation without relying upon an auxilary locking mechanism or a friction device, or requiring the user of the device to move it through a secondary locking motion. Accordingly, it is an object of the present invention to provide an ambulatory assistance device such as a grab bar or the like which may be moved between a non-in-use position and an in-use position and which will retain the selected position or orientation without relying upon an auxilary locking mechanism or a friction device, or requiring the user of the device to move it through a secondary motion in order to lock it in the selected position.

It is a further object of the present invention to provide an ambulatory assistance device such as a grab bar or the like which may be easily moved between a non-in-use position and an in-use position by the user of the device. Other and more detailed objects of the present invention will become apparent to those skilled in the art upon examination of the disclosure contained herein.

DETAILED DESCRIPTION OF THE PREFERRED EMBODIMENT

Figure 1:
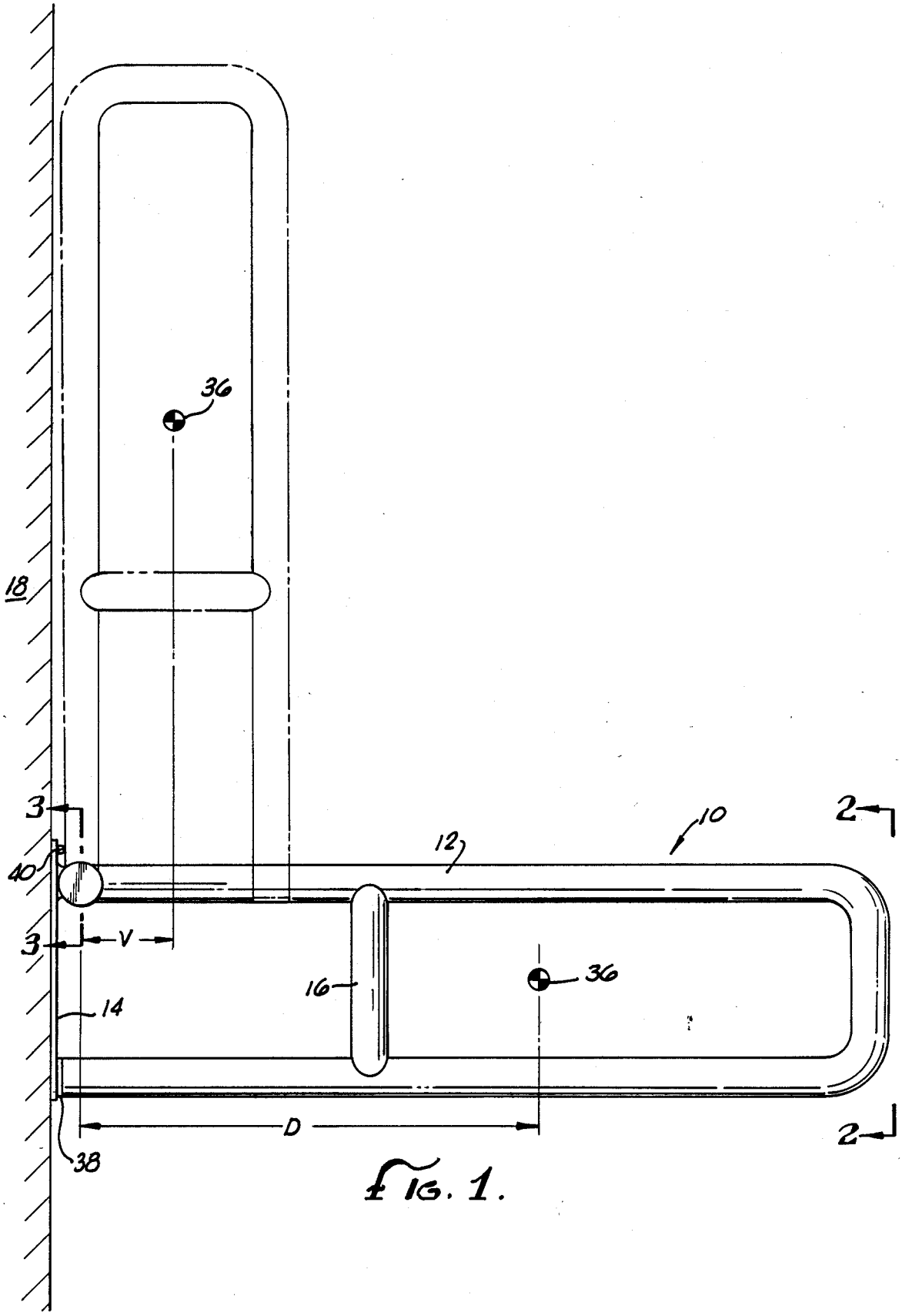
FIG. 1 is a side view of a preferred embodiment of the present invention shown in the in-use position with the non-in-use position shown in phantom.
Figure 2:
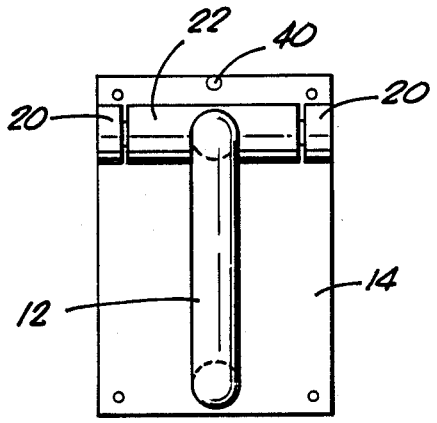
FIG. 2 is a front view of a preferred embodiment of the present invention shown from substantially along line 2—2 of FIG. 1.

As is illustrated by the figures, the preferred embodiment of the present invention is a grab bar device 10 or the like which includes a body 12 pivotally connected to a base member 14. In the preferred embodiment of the present invention, the body 12 is substantially U-shaped and includes a cross link 16 to provide the body 12 with additional structural support and rigidity. In addition, the body 12 is arranged in such a manner as to provide the user with a variety of places to grip the device. Thus, in addition to being simple to manufacture and use, the preferred embodiment of the present invention includes the ability to be gripped in an almost unlimited number of places by the user, including along the cross link member. The user may conveniently use the grab device 10 as a handle for assisting in sitting down or arising from a seat, such as a toilet, positioned adjacent the device 10. As will be well understood to those skilled in the art, however, alternative body figurations and uses are easily possible without departing from the scope of the present invention.

The base member 14 is adapted to be connected to a wall 18 or some other independent structural member of sufficient strength so as to permit the present invention to be used as an ambulatory assistance device. Although the preferred embodiment of the present invention illustrates a single base member 14 pivotally connected to the body 12, additional base members could be connected to alternative body constructions without departing from the teachings of the present invention.

In order to pivotally mount the body 12 to the base member 14, the preferred embodiment of the present invention includes a pair of anchor blocks 20 rigidly affixed to the base member 14. A support collar 22 is rigidly affixed to a first end of the body 12. The support collar 22 is pivotally supported by a pivot shaft 24 which extends between the oppositely arranged anchor blocks 20. The pivot shaft 24 is preferably secured in longitudinal alignment with the anchor blocks 20 by centering cap bushing means 26 in each anchor block.

The pivot shaft 24 is also secured at both ends to the base member 14 by securing pin means 25 which extend from the base member 14 and through each longitudinal end of the pivot shaft 24. Similarly, the securing pin means 25 also extend through the centering cap bushing means 26 so as to prevent disassembly of the present invention. The support collar 22 is provided with a stationary bearing bushing means 28 at one end and a rotary bearing bushing means 30 at the other longitudinal end thereof. The stationary bearing bushing means 28 is preferably connected to the stationary pivot shaft 24 through a set screw means 29 in order to secure its non-rotating position. Similarly, the rotary bushing bearing means 30 is preferably secured to the rotatable support collar 22 through a second set screw means 31.

Figure 3:
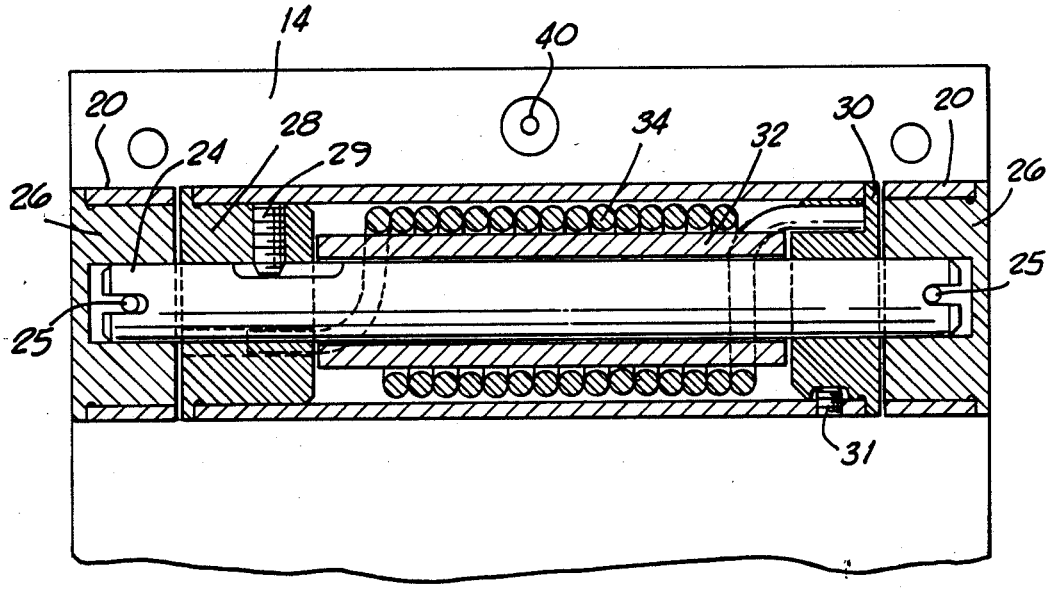
FIG. 3 is a sectional view of a portion of the preferred embodiment of the present invention shown substantially along line 3—3 of FIG. 1.

A torsion device 23 is preferably provided between the rotatable support collar 22 and the fixed anchor blocks 20. As illustrated most clearly in FIG. 3, the preferred embodiment of the torsion device 23 includes a tubular alignment shaft 32 and a torsion spring 34. The alignment shaft 32 is positioned within the rotatable collar 22 and slidably about the pivot shaft 24. The alignment shaft preferably extends from the stationary bearing bushing means 28 to the rotary bearing bushing means 30 but is not connected to either. In the preferred embodiment of the present invention, the torsion spring 34 is secured at one end to the stationary bearing bushing means 28 while the other end of the torsion spring 34 is secured to the rotary bearing bushing means 30.

An upper bumper 40 is provided on the base member 14 and is arranged so as to keep the grab bar device from hitting the wall 18 when the device is in the pivoted non-in use position. A similar bumper or stop 38 is provided over the free second end of the device body 12 for engaging the base member 14 to stop the body 12 in a horizontal in-use position for supporting the users weight or force on the body 12. The bumber 38 also protects the user of the device from possible injury when the body 20 is provided upwardly.

The body 12 of the present invention has a center of gravity 36 which may be determined either empirically or experimentally. As is best illustrated in FIG. 1, the body center of gravity 36 will have a first moment arm "U" when the device is in the pivoted upwardly to the non-in-use position and a second moment arm "D" when the device is in the substantially extended or downward in-use position. When selecting the torsion means 23, it is necessary to evaluate the weight of the body 12 and the length of these moment arms U and D. The selection of the torsion means 23, and particularly the torsion spring 34 of the preferred embodiment of the present invention, may be determined as follows.

In selecting the torsion member for use with the present invention, it is necessary to determine the torque associated with the pivoting body of the present invention, including the body member 12 and any associated elements or members connected thereto and pivoting therewith such as the crosslink member 16 as they pivot between the device in-use down position and the device non-in-use up position. This torque may be calculated by multiplying the weight of the pivoting body by the distance between the center of gravity and the pivot point. In order to maintain the bar in the stored non-in-use up position without any latching mechanism, the torque provided by the torsion member 23 in the counterclockwise direction, as viewed in FIG. 1, must be greater than the clockwise torque produced by the weight of the pivoting body when the device is in the non-in-use stored position.

Similarly, it is possible to calculate or measure the clockwise torque produced by the weight of the pivoting body when it is in the substantially in-use downwardly pivoted position. In order to insure that the device will stay in the in-use pivoted position when it is moved to that position by the user of the device 10, the counterclockwise torque provided by the torsion member 23 must be less in the in-use position than the clockwise torque produced by the weight of the pivoting body. By such an arrangement, the torque produced by the weight of the pivoting body will be sufficient to retain the device in the substantially downward position when the user so positions the device. In addition, the torsion member will act to assist the user of the device in pivoting the present invention between the non-in-use position and the in-use position such that the ambulatory assistance device of the present invention may be pivoted quite easily. Friction forces between any adjacent parts of the present invention assist the torsion device in increasing the stability of the present invention to remain in any selected position.

For purposes of example, in one embodiment of the present invention, the body member 12 and the cross link 16 were constructed from a U-shaped 1¼ inch diameter stainless steel tubing to extend outwardly from the wall 32" in the down position. The resultant body 12 had a weight of 3.65 lbs. The support collar 22 was constructed from a 1½ inch diameter stainless steel tube which was welded to one end of the U-shaped body member 12. The anchor blocks 20 were constructed from two 1 ½ inch diameter stainless steel rings which were welded to a 3/16 inch steel plate which served as the base member 14. The pivot shaft 24 was constructed from a piece of ½ inch diameter stock and was supported at both ends by plastic centering cap bushing means 26 positioned in each of the anchor blocks 20. By this construction, the moment arm U was 3.35 inches and the moment arm D was 15.77 inches. Thus the weight-produced torque was 12.2 in the up position and 57.5 in lbs. in the down position. Thus the torsion member 23 was required to produce more than 12.2 in lbs. in the up position and less than 57.5 in lbs. in the down position, i.e., after 90° downward rotations.

In this embodiment, a torsion spring was chosen as the torsion member 23 and the spring constant was selected to produce the desired torque, as described above. The spring extended from the plastic stationary bearing bushing means 28 at one end to the rotary bearing bushing means 30 at the other end. The stationary bearing bushing means 28 was secured to the pivot shaft 24 through a set screw means. Similarly, the rotary bearing bushing means 30 was secured to the rotating support collar 22 through a second set screw means. The torsion spring was connected to the rotary bearing bushing means 30 at one end and to the stationary bearing bushing means 29 at the other end by inserting each end of the spring into a hole in the respective bearing bushing means.

As stated above, the spring acted to counteract the torque produced by the wight of the pivoting body when the device was in the pivoted non-in-use position to hold the body in the upward, non-in-use position to hold the body in the upward, non-in-use position while permitting the torque produced by the pivoting body to overcome the force of the torsional spring member 34 when the grab bar device was in the horizontal in-use position to allow the body 12 to remain in the downward in-use position. Moreover, the spring acted to counteract the weight of the body of the device during the rotation stroke between the non-in-use position and the in-use position so as to permit the easy and convenient use of the device of the present invention.

In a test of one embodiment of the present invention similar to that described above, the device was operated in excess of 100,000 cycles without failure. Thus, it is believed that the present invention provides a simple yet reliable device which may be easily operated by persons who need the assistance of an ambulatory assistance device such as a grab bar or the like according to the present invention. Moreover, it is believed that the teachings of the present invention are equally applicable to other devices wherein it is desirable to have the device easily pivot between a non-in-use position and an in-use position. Accordingly, although a preferred embodiment of the invention is described herein, persons skilled in the art will understand that the present invention may be applied to other devices without departing from the teachings hereof. Accordingly, the scope of this invention is limited only by the claims appended hereto.

I claim:

1. An ambulatory assistance device such as a grab bar or the like, comprising, a substantially U-shaped body lying in a vertical plane, said body including at least one cross link member to increase the stability and rigidity of said body, said body being arranged so as to have a plurality of gripping surfaces, a base member, said base member including a pair of anchor blocks and a horizontal pivot shaft extending between said anchor blocks, said body being arranged to pivot about said pivot shaft, and a torsion member, said torsion member including a torsion spring, said torsion spring being arranged to provide torsional force between said body member and said base member, said body being pivotable between a horizontally extending position wherein the weight of the body retains the body in that position in opposition to the torsion spring and a vertically extending position wherein the torsion spring retains the body in that vertically extending position in opposition to the weight of the body, wherein said body has a collar encircling said pivot shaft with an annular space provided therebetween, a first bearing bushing connected to said pivot shaft and rotatably supporting a first end of said collar, and a second bearing bushing connected to a second end of said collar and rotatably supported on said pivot shaft.

2. The device of claim 1, wherein said torsion spring is in the form of a coil spring encircling and extending along said pivot shaft with a first end connected to said first bearing bushing and a second end connected to said second bearing bushing for circumferentially winding and unwinding said torsion spring upon pivoting of said body.

* * * * *

US004908906B1

REEXAMINATION CERTIFICATE (2143rd)

United States Patent [19]

[11] B1 4,908,906

Hanna

[45] Certificate Issued Dec. 7, 1993

[54] AMBULATORY ASSISTANCE DEVICE SUCH AS A GRAB BAR OR THE LIKE

[75] Inventor: Emmanuel Hanna, Sun Valley, Calif.

[73] Assignee: Bobrick Washroom Equipment, Inc., Hollywood, Calif.

Reexamination Request:
No. 90/002,781, Jul. 10, 1992

Reexamination Certificate for:

| | |
|---|---|
| Patent No.: | **4,908,906** |
| Issued: | **Mar. 20, 1990** |
| Appl. No.: | **67,105** |
| Filed: | **Jun. 25, 1987** |

[51] Int. Cl.[5] ..... A47K 17/02
[52] U.S. Cl. ..... 16/126; 4/576
[58] Field of Search ..... 16/126, 112, 113, 110 R, 16/DIG. 24, 306, 307, 308, 289; 4/576; 5/445

[56] References Cited

U.S. PATENT DOCUMENTS

| | | | |
|---|---|---|---|
| 823,372 | 6/1906 | Stevens et al. | 16/1 |
| 2,059,171 | 10/1936 | Harris | 4/576 |
| 3,228,038 | 1/1966 | Augustine | 4/576 |
| 3,286,283 | 11/1966 | Bertoldo | 5/445 |
| 3,562,849 | 2/1971 | Brayshaw | 16/126 |
| 4,657,233 | 4/1987 | Vroom | 267/155 |

FOREIGN PATENT DOCUMENTS

| | | | |
|---|---|---|---|
| 1964410 | 7/1971 | Fed. Rep. of Germany | 4/576 |

*Primary Examiner*—John Sipos

[57] ABSTRACT

The present invention provides an ambulatory assistance device such as a grab bar or the like which pivots between a non-in-use and an in-use position. The pivoting of the device is assisted by a torsion member acting between the base member and the body. The torsion device is selected so as to retain the body in its non-in-use position when placed in that position. The weight of the pivoting body of the present invention overcomes the force generated by the torsion member when the body is placed in the in-use position so as to retain that orientation. Moreover, the torsion member acts to assist the user of the device in counteracting the weight of the pivoting body member when the body member is moved between the non-in-used position and the in-use position.

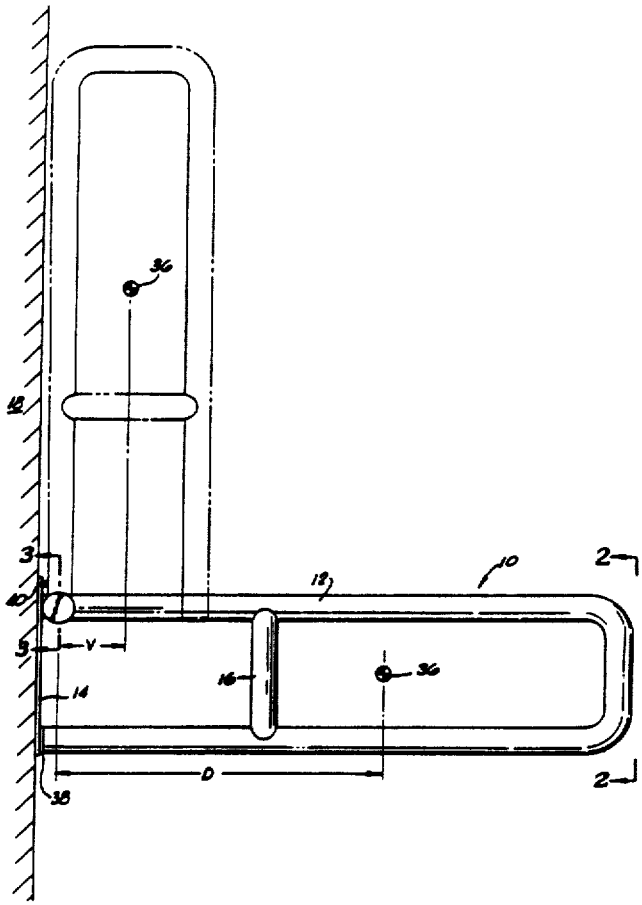

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 1 is determined to be patentable as amended.

Claim 2, dependent on an amended claim, is determined to be patentable.

1. [An ambulatory assistance device such as a] *A* grab bar [or the like] *for use by a handicapped person for ambulatory assistance,* comprising, a substantially U-shaped body lying in a vertical plane, said body including at least one cross link member to increase the stability and rigidity of said body, said body being arranged so as to have a plurality of gripping surfaces, a base member, said base member including a pair of anchor blocks and a horizontal pivot shaft extending between said anchor blocks, said body being arranged *for gripping by a person* to pivot *said body* about said pivot shaft, and a torsion member, said torsion member including a torsion spring, said torsion spring being arranged to provide torsional force between said body member and said base member, said body being pivotable *by the person using the grab bar* between a horizontally extending position wherein the weight of the body retains the body in that position in opposition to the torsion spring *after release by the person* and a vertically extending position wherein the torsion spring retains the body in that vertically extending position in opposition to the weight of the body *after release by the person,* wherein said body has a collar encircling said pivot shaft with an annular space provided therebetween, a first bearing bushing connected to said pivot shaft and rotatably supporting a first end of said collar, and a second bearing bushing connected to a second end of said collar and rotatably supported on said pivot shaft.

* * * * *